US005470085A

United States Patent [19]

Meibock et al.

[11] Patent Number: 5,470,085

[45] Date of Patent: Nov. 28, 1995

[54] BRAKING APPARATUS FOR IN-LINE ROLLER SKATES

[75] Inventors: Antonin A. Meibock, Cleveland, Ohio; John E. Svensson, Seattle, Wash.

[73] Assignee: K-2 Corporation, Vashon, Wash.

[21] Appl. No.: 188,961

[22] Filed: Jan. 26, 1994

Related U.S. Application Data

[63] Continuation-in-part of Ser. No. 94,576, Jul. 19, 1993, Ser. No. 100,745, Aug. 2, 1993, and Ser. No. 120,629, Sep. 13, 1993.

[51] Int. Cl.[6] ..... A63C 17/14

[52] U.S. Cl. ..... 280/11.2; 188/5; 280/11.22

[58] Field of Search ..... 280/11.19, 11.2, 280/11.21, 11.22, 87.042; 188/5

[56] References Cited

U.S. PATENT DOCUMENTS

| | | | |
|---|---|---|---|
| D. 315,941 | 4/1991 | Olson et al. | D21/226 |
| D. 321,393 | 11/1991 | Olson et al. | D21/226 |
| D. 323,540 | 1/1992 | Graham | D21/225 |
| D. 324,713 | 3/1992 | Rubin | D21/226 |
| D. 344,119 | 2/1994 | Johnson et al. | D21/226 |
| 334,739 | 1/1886 | Blum . | |
| 2,021,316 | 11/1935 | Marx | 208/173 |
| 2,191,018 | 2/1940 | Ickenroth | 280/11.20 |
| 2,644,692 | 5/1951 | Kahlert | 280/11.22 |
| 3,224,785 | 12/1965 | Stevenson | 280/11.2 |
| 3,580,594 | 5/1971 | Ware | 280/11.2 |
| 3,844,574 | 10/1974 | Kosono et al. | 280/11.2 |
| 4,181,227 | 1/1980 | Balstad | 280/11.2 |
| 4,298,209 | 11/1981 | Peters | 280/11.2 |
| 4,453,726 | 6/1984 | Ziegler | 280/11.2 |
| 4,807,893 | 2/1989 | Huang | 280/11.2 |
| 4,909,523 | 3/1990 | Olson | 280/11.2 |
| 5,028,058 | 7/1991 | Olson | 280/11.22 |
| 5,048,848 | 9/1991 | Olson et al. | 280/11.22 |
| 5,052,701 | 10/1991 | Olson | 280/11.2 |
| 5,067,736 | 11/1991 | Olson et al. | 280/11.2 |
| 5,068,956 | 12/1991 | Malewicz | 29/437 |
| 5,088,748 | 2/1992 | Koselka et al. . | |
| 5,092,614 | 3/1992 | Malewicz | 280/11.22 |
| 5,129,663 | 7/1992 | Soo | 280/7.14 |
| 5,171,033 | 12/1992 | Olson et al. | 280/11.22 |
| 5,192,099 | 3/1993 | Riutta . | |
| 5,211,409 | 5/1993 | Mitchell et al. | 280/11.2 |
| 5,253,882 | 10/1993 | Mitchell | 280/11.2 |
| 5,253,883 | 10/1993 | Moldenhauer | 280/11.2 |
| 5,257,795 | 11/1993 | Babcock | 280/11.2 |
| 5,275,259 | 1/1994 | Roberts | 280/11.2 X |
| 5,280,931 | 1/1994 | Horton | 280/11.2 |
| 5,348,320 | 9/1994 | Gay | 280/11.2 |

*Primary Examiner*—Richard M. Camby
*Assistant Examiner*—Michael Mar
*Attorney, Agent, or Firm*—Christensen, O'Connor, Johnson & Kindness

[57] ABSTRACT

A braking system is provided for use on an in-line roller skate wherein the braking system minimizes canting of the in-line roller skate to apply the in-line roller brake, and wherein the brake pad is securely held to a substantially rigid brake housing using interlocking grooves and ridges, and a fastening lug, which extends into a corresponding aperture formed within the brake pad. The brake housing includes two plate members, which have an aperture on their forwardmost end for securing and attaching the plate members to an axle assembly of a rearwardmost wheel of the in-line roller skate. An arm is provided to secure the brake housing to an upper portion of the lower frame of the in-line roller skate, and the arm includes a hook for engaging a ridge disposed within the lower frame of the in-line roller skate. The braking system is thus held in place by a three-point fastening system to the rear of the in-line roller skate.

8 Claims, 6 Drawing Sheets

BRAKING APPARATUS FOR IN-LINE ROLLER SKATES

RELATED APPLICATION

This is a continuation-in-part of utility applications Ser. Nos. 08/094,576, filed Jul. 19, 1993; 08/100,745, filed Aug. 2, 1993, and 08/120,629, filed Sep. 13, 1993, pending the benefit of the filing dates of which is claimed herein.

FIELD OF THE INVENTION

The present invention generally relates to in-line roller skates having an upper shoe for securely holding a skater's foot connected by a fastener to a lower frame having an in-line brake or speed-control system. More specifically, the present invention relates to a rear-mounted brake that is usable with in-line roller skates.

BACKGROUND OF THE INVENTION

In-line roller skates include a plurality of wheels mounted in line, one behind the other, in a common, longitudinally extending plane. The in-line wheels are typically carried and supported by a lower frame. The lower frame provides a rigid structure or undercarriage for the in-line roller skate wheels and braking system. Conventional in-line roller skates include an upper shoe or boot that is securely attached to the lower frame. The upper shoe provides a support structure for the skater's foot.

In-line roller skates are commonly used outside on uneven sidewalks, bicycle paths, and roadways. The skates are very maneuverable and skaters can achieve speeds of up to 30 miles an hour when skating down a hill—substantially faster than the speeds customarily achieved by skaters using conventional paired-wheel roller skates. In-line roller skating is generally considered to require higher levels of skill, coordination, and strength than conventional paired-wheel roller skating because of the narrow, lateral support base associated with in-line roller skates. Because of the high speeds that can be attained and the relatively greater skill levels required for maneuvering safely when using in-line roller skates, it is important that in-line roller skates have reliable and efficient means for controlling a skater's speed and bringing the skater to a quick, safe, and controlled stop. Specifically, in-line roller skates should have a well-designed and easily applied braking system. This requirement is particularly important for skaters who are less experienced and unable to maneuver so as to avoid collisions.

The primary purpose and function of the braking system on in-line roller skates is to enable a skater to maintain control over speed and direction of motion, to avoid injury to himself and to others. One technique used for braking requires that the skater drag the skate wheels across the ground to create a frictional drag force. This braking method is accomplished by shifting weight over one skate and turning the wheels of the second skate perpendicular to the direction of motion, while forcing the wheels against the skating surface. Alternatively, the skater can use tight-radii S-turns to reduce speed by creating high lateral forces against the wheels, causing the wheels to skid slightly and thereby providing a braking action. However, balancing on one foot while dragging the wheels or making rapid directional changes is difficult, even for expert skaters, particularly at high speeds; therefore, there is a need for a more effective and easily applied braking system, particularly for skaters who are less skilled.

Another approach more commonly used in braking systems for in-line roller skates employs a friction pad mounted at the rear of a skate. A molded rubber pad or plug is mechanically fastened to the rear of the in-line roller skate frame, positioned behind the rearwardmost in-line roller skate wheel, approximately one inch above the skating surface. Braking is achieved by lifting the front of the in-line roller skate and dragging the pad on the skating surface. Since the skater is relying on the friction created between the pad and the skating surface, it is important to provide as much frictional contact between the pad and the skating surface as possible, and to require only a minimal canted angle of the in-line roller skate when braking with the pad.

Until recently, the rear-mounted brake pad used with in-line roller skates has typically comprised a rubber cone- or cylinder-shaped body extending axially from the rear of the skate. While this type of braking system functions adequately, it is desirable to improve the performance so as to make braking as effective and reliable as possible, while minimizing the repositioning of the skate that is required to apply the brake.

In designing an improved rear-mounted brake for an in-line roller skate, it is important that the area off fictional contact and coefficient of friction of the brake pad remain relatively constant over the life of the pad. For example, a brake pad should not require a break-in or wear period to flatten the brake pad sufficiently so that it develops maximum drag. Circular pads commonly used on in-line roller skates have only a portion of the periphery of the circular pad contacting the road surface when the brake pad is new, resulting in poor braking performance until the brake pad has worn sufficiently to provide a greater contact area. In addition to exhibiting poor braking performance when the brake pad is new, there is significant wear of the circular brake pad early in its life, which significantly increases the cant angle of the skate required to bring the brake pad into contact with the skating surface.

A further requirement of braking systems on in-line roller skates is the width of the braking system in relation to the upper shoe and the lower frame. Brake pads should not extend laterally beyond the width of the skate frame, or the brake pad may snag on roadway obstacles, possibly causing the skater to fall. An effective rear-mounted brake must also be configured to avoid snagging when the skater encounters an incline, such as a driveway apron, or when crossing surfaces of irregular height, or cracks in sidewalks or roads. Prior art brakes have avoided this problem by mounting the brake pads sufficiently above the road surface to avoid accidental contact.

While mounting the brake pad higher above the skating surface avoids snagging of the brake system, the skater must often cant the skate through an angle of at least 15 degrees to apply the brake pad to the skating surface, which may jeopardize balance. An inexperienced skater can find it very intimidating to pivot his foot through such an angle while balancing on the other foot in order to apply the braking system.

An additional concern related to the design of braking systems that are attached to the rear of in-line roller skates is that when the brake pad is enlarged to obtain an adequate contact area with the skating surface, the additional forces applied to the brake pad during its use are substantially increased. An excessive force can damage the brake pad mounting or disengage the pad from the lower frame of the skate.

Accordingly, there is a need for a braking system that takes each of these concerns into consideration and enables even less skilled skaters to execute a safe and efficient braking maneuver.

SUMMARY OF THE INVENTION

In accordance with the present invention, a braking system is provided that is adapted for use on an in-line roller skate having an upper shoe and a lower frame. The braking system is mounted on a rear portion of the lower frame behind a plurality of in-line wheels attached to the lower frame by a plurality of axle assemblies. The braking system is preferably mounted behind the rearwardmost wheel using the axle assembly of the rearwardmost wheel.

The braking system includes a substantially rigid brake housing comprising a pair of plates adapted for mounting on each side of the axle assembly of the rearwardmost wheel of the lower frame. This housing also includes an arm having a hook for attaching the braking system to the lower frame, and a brake pad attached to a bottom portion of the brake housing at a point where the pair of plates and the arm form an apex angle.

The brake housing also preferably includes a substantially vertical lug that protrudes partially through an aperture in the brake pad. In addition, the pair of plates include substantially vertical ridges (or grooves) for interconnecting with substantially vertical grooves (or ridges) in the brake pad, to ensure that the brake pad is firmly held in place on the rigid brake housing.

Because of its novel design, the present braking system requires minimal canting of the in-line roller skate to apply the brake. In addition, when a substantial braking force is applied to the brake pad, the brake pad will not disengage from the brake housing.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

Detailed Description of the Preferred Embodiment

Figure 1:
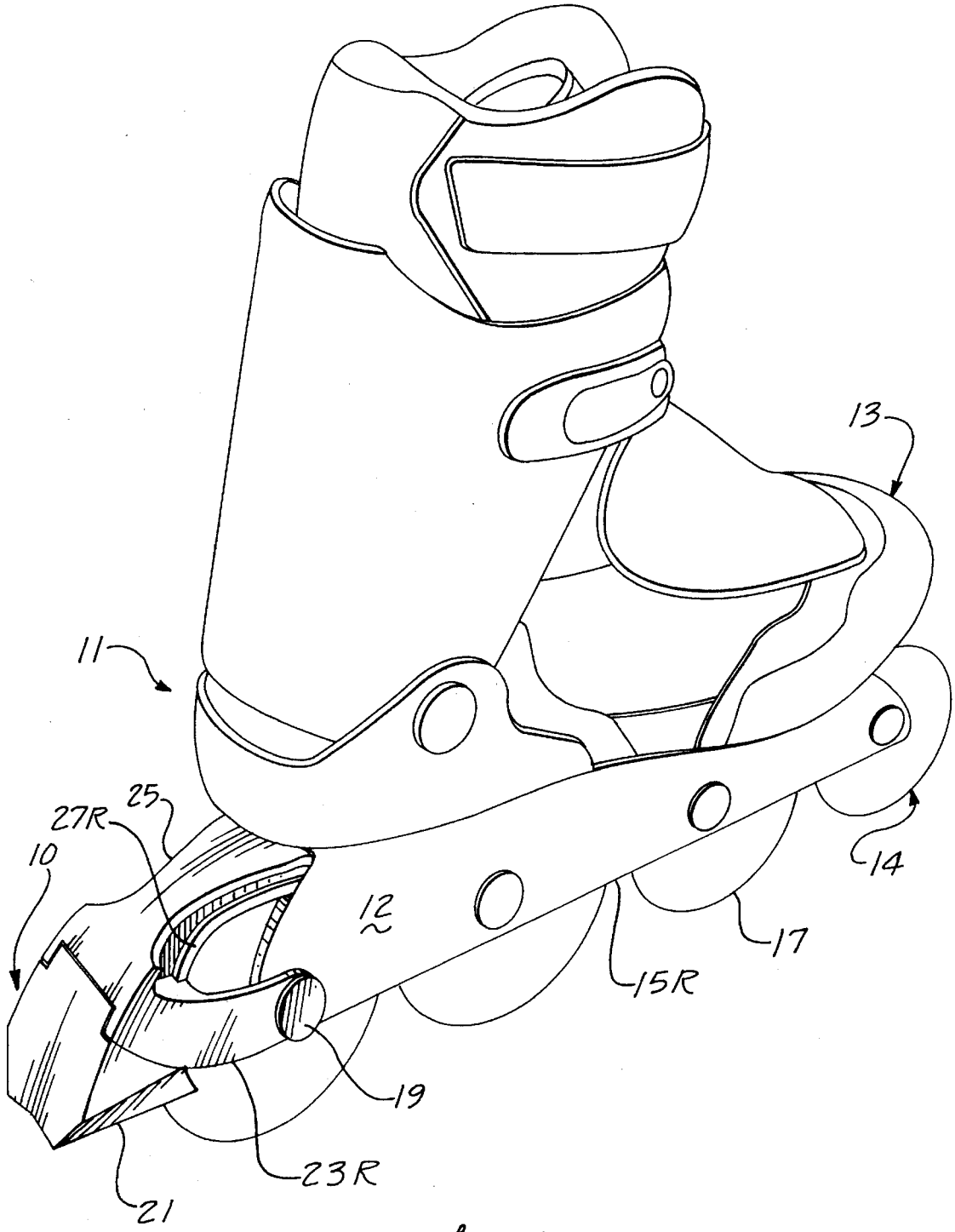
FIG. 1 a perspective view of the present invention illustrating an in-line roller skate having an upper shoe, a lower frame, and a braking system.

Referring to FIG. 1, an in-line roller skate 11 is shown having an upper shoe 13 and a lower frame 14. The lower frame 14 includes a plurality of in-line roller wheels 17, mounted in line one behind the other, rotatable in a common, longitudinally extending plane of rotation. The in-line roller wheels 17 are mounted to the lower frame 14 with axle assemblies 19. The lower frame 14 may include frame rails 15R and 15L as a single integrated unit having an upper mounting platform 32 for securing the upper shoe 13 to the lower frame 14. Alternatively, the lower frame 14 may include independent frame rails 15R and 15L that are separate from the upper mounting platform 32, so that the frame rails 15R and 15L are secured to the mounting platform 32 and the platform 32 is secured to the upper shoe 13. FIG. 1 also illustrates a rear-mounted braking system 10 in accordance with the present invention. The rear-mounted braking system 10 includes a brake pad 21, mounting plates 23R and 23L, and a mounting arm 25; these components are discussed in further detail below.

Figure 2:
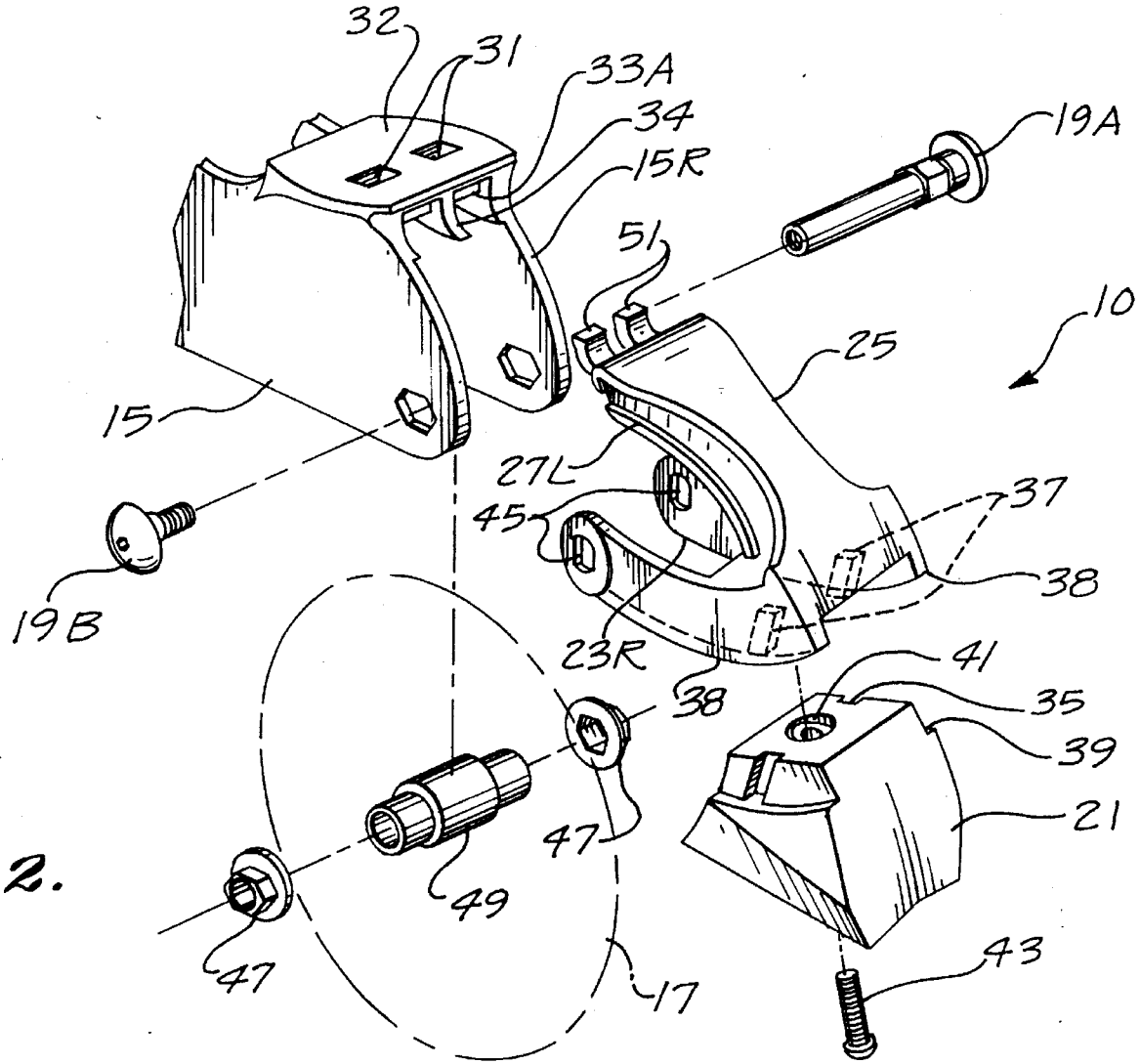
FIG. 2 is an exploded perspective view of the lower frame and the braking system of the present invention in a first embodiment.

Referring now to FIG. 2, the various components comprising the rear portion 12 of the lower frame 14 and the rear-mounted braking system 10 are shown in an exploded view. More specifically., in a first embodiment, the rear portion 12 of the lower frame 14 includes lower frame hook apertures 31 in the upper mounting platform 32. Below and slightly to the rear of the hook apertures 31 is a lower frame hook ridge **33*a*. As will be described in greater detail hereafter, the hook apertures 31 and hook ridge 33*a* secure the arm 25 to the rear portion 12 of the lower frame 14. Finally, as shown in FIG. 2, the rear axle assembly 19 includes a barrel bolt 19*a* and an axle bolt 19B, which secure the rearwardmost wheel 17 to the lower frame 14. The rear axle barrel bolt 19*a* and the axle bolt 19B also secure the mounting plates 23R and 23L to the rear portion 12 of the lower frame 14**.

The rear-mounted braking system 10 shown in FIG. 2 includes a brake pad 21, which is secured to an apex formed by the junction of the mounting plates 23R and 23L, and the arm 25; the brake pad 21 is secured to the apex with a bolt 43. The brake pad 21 is specifically shaped to provide efficient braking without requiting the skater to excessively cant the in-line roller skate 11 to apply the brake. Further, the brake pad 21 does not require a break-in period since the brake pad 21 is configured to provide the maximum surface contact with the skating surface from its first day of use.

The brake pad 21 includes a partial brake pad aperture 41 for engaging a fastening lug 53 positioned at the apex of the mounting plates 23R and 23L and the arm 25. The brake pad 21 further includes grooves 35 on each side of the brake pad 21 for interlocking with correspondingly sized ridges 37, which are formed on the inner surfaces of both mounting plates 23R and 23L. While the preferred embodiment of the present invention provides grooves 35 in the brake pad 21 and ridges 37 on the mounting plates 23R and 23L, it will be readily apparent to those skilled in the art that the disposition of the ridges and grooves on these components can be reversed, so that the ridges are formed on the brake pad and the grooves are formed on the mounting plates. Furthermore, any combination of grooves 35 and ridges 37 can be combined to provide the advantages of the present invention. More particularly, any combination of grooves and ridges that are oriented to accommodate vertical installation of the brake pad 21 when the in-line roller skate is in an upright position normal to its use, so that the grooves and ridges engage each other to substantially oppose a horizontal braking force are contemplated to fall within the scope of the present invention.

Brake pad 21 further includes a support ridge 39 for matingly engaging a lower surface 38 of the mounting plates 23R and 23L. The support ridge 39, in combination with a partial brake pad aperture 41, fastening lug 53, mounting plate ridges 37, and brake pad grooves 35 securely hold the brake pad 21 in place when a braking force is applied to the brake pad 21.

Figure 3:
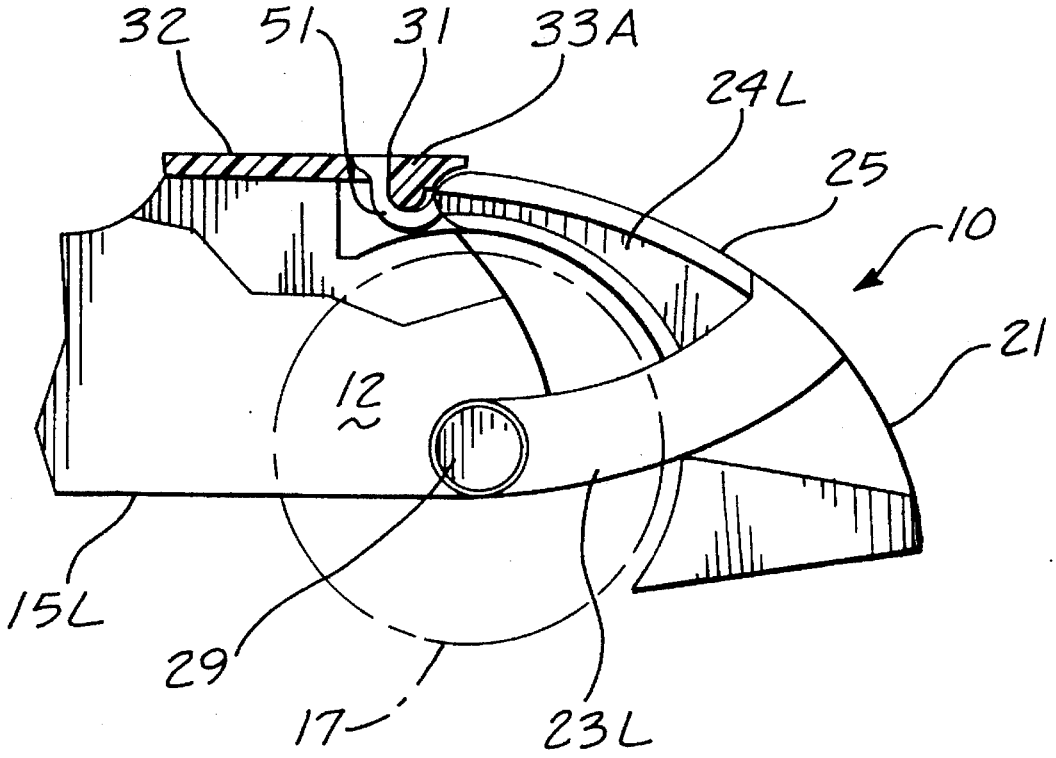
FIG. 3 is a partial side sectional view of the lower frame and the braking system of the present invention in a first embodiment.

Referring now to FIG. 3, the preferred embodiment of the present invention is shown as it would appear mounted on the rear portion 12 of the in-line roller skate 11. The arm 25 and the mounting plates 23R and 23L form a three-point mounting system for the rear-mounted brake 10. Preferably, the mounting plates 23R and 23L include mounting plate apertures 45 for receiving the rear axle assembly barrel bolt **19*a* and the axle bolt 19*b* to secure, he rear-mounted brake 10 to the rear portion 12 of the lower frame 14. The arm 25 includes at least one support hook 51, but can include additional support hooks 51 to securely hold the arm 25 in place. The support hooks 51 are attached to a forward end of the arm 25. The support hooks 51 engage a lower frame hook ridge 33*a* and, in the preferred embodiment of the present invention, the hooks 51 extend upwardly through the lower frame hook apertures 31 in the upper mounting platform 32. Preferably, the hooks 51 are flush with the upper surface of the upper mounting platform 32. In addition, where a plurality of hooks 51 are used, the lower frame hook ridge 33*a* may include one or more support partitions 34. The mounting plates 23R and 23L are secured to the rear portion 12 of the lower frame 14 with the rear axle assembly 19**.

Figure 4:
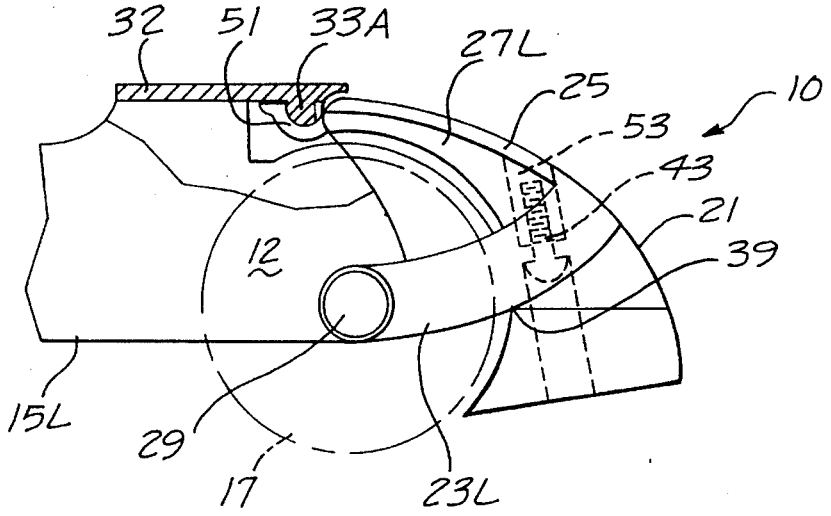
FIG. 4 is a partial side sectional view of the lower frame and the braking system of the present invention in a second embodiment.
Figure 5:
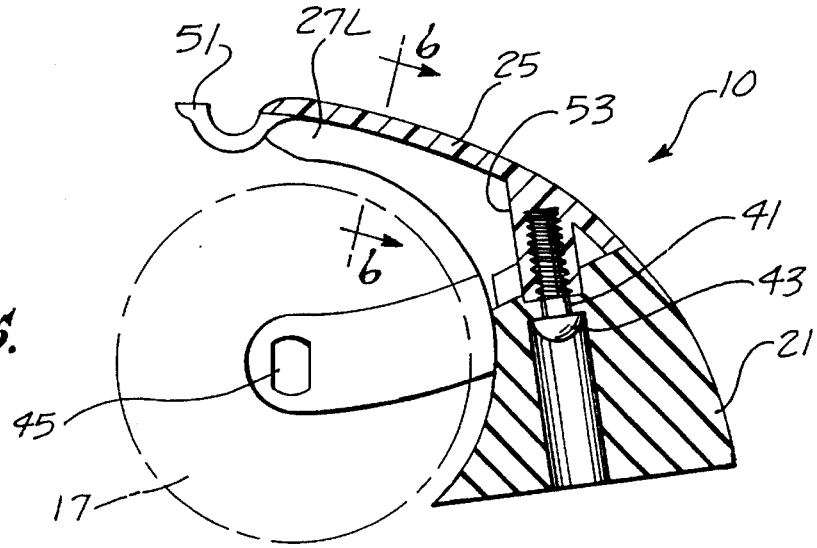
FIG. 5 a partial side sectional view of an in-line wheel and the braking system of the present invention in the first or second embodiment.
Figure 6:
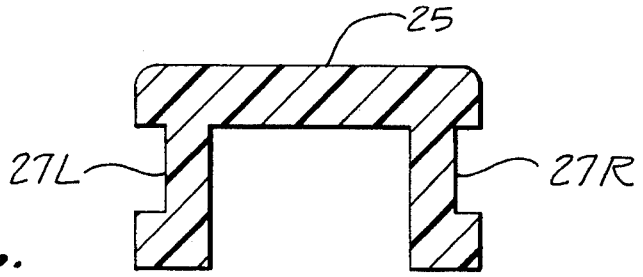
FIG. 6 is sectional view taken along the section line 5—5 of FIG. 5.

Referring to FIG. 4 and FIG. 5, a second embodiment of the present invention is shown, wherein the support hooks 51 matingly engage the lower frame hook ridge **33*a*, however the support hooks 51 do not penetrate the upper mounting platform 32, as shown in FIG. 3. Also shown in FIGS. 4 and 5 is the fastening lug 53. The fastening lug 53 extends into a corresponding aperture 41 formed part way through the thickness of the brake pad 21 when the bolt 43 is threaded into the fastening lug 53. The penetration of the fastening lug 53 into the brake pad 21 further prevents the brake pad 21 from disengaging from the mounting plates 23R and 23L and the arm 25 when a braking force is applied to the brake pad 21. Further, when the bolt 43 is tightened into the fastening lug 53, the mounting plate ridges 37, brake pad grooves 35, and fastening lug 53 together cooperate to securely hold the brake pad 21** in place when braking forces are applied.

The rigidity of the braking system 10 is an important characteristic and is essential to ensure that the braking system does not flex excessively when contacting the skating surface. Such flexure could allow support hooks 51 to disengage from the arm 25. To provide the necessary rigidity, arm 25 includes a left brace 27L and a fight brace 27R. The braces 27L and 27R prevent the arm 25 and the support hooks 51 from flexing downwardly toward the mounting plates 23R and 23L and thus also prevent the hooks 51 from disengaging the lower frame hook ridge **33*a***.

Figure 7:
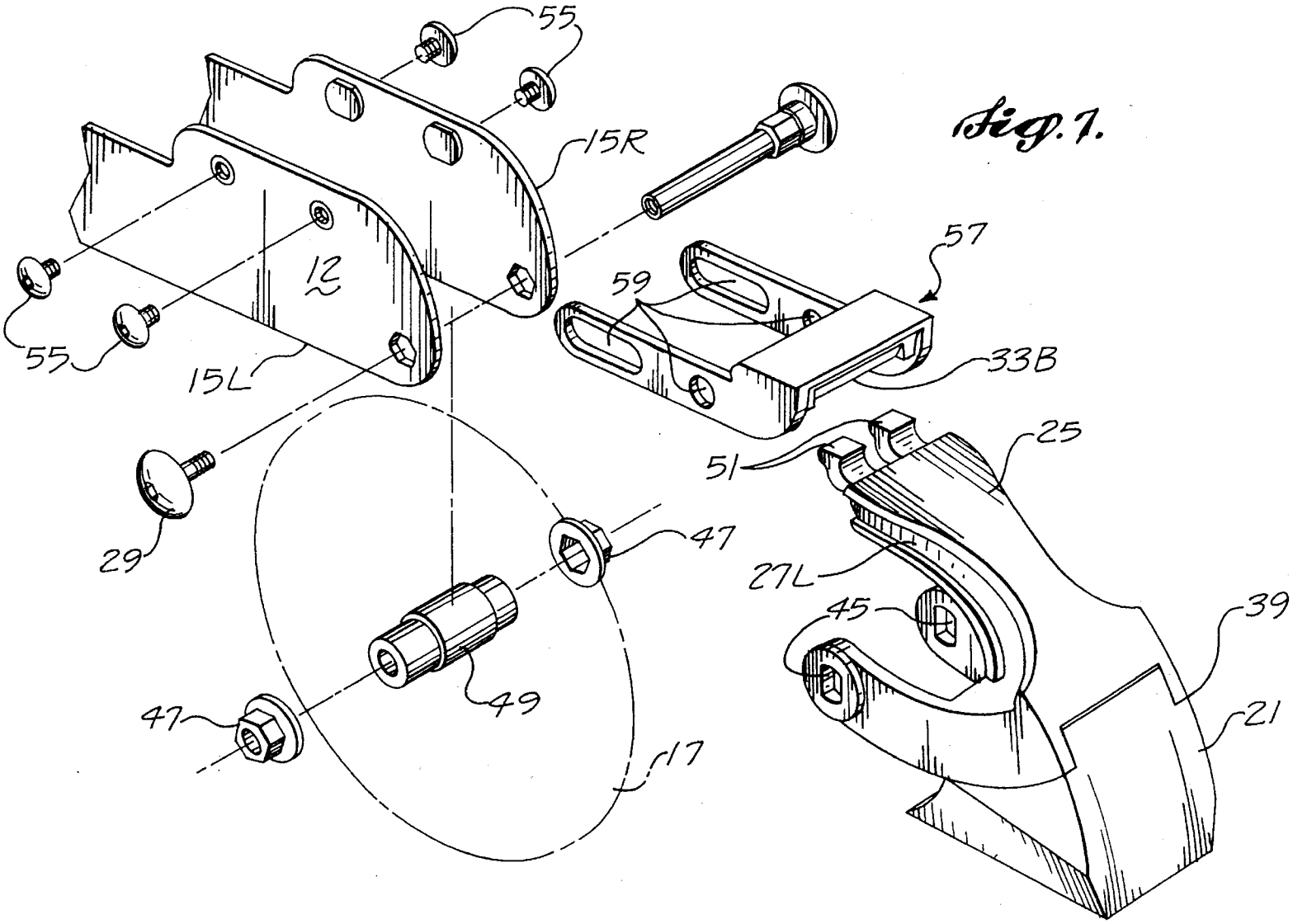
FIG. 7 is an exploded perspective view of a lower frame and the braking system of the present invention in a third embodiment including a U-shaped rear brake securing plate.

Referring now to FIG. 7, a braking system 10' is shown that is adapted for mounting on the alternative lower frame 14 of an in-line roller skate having removable frame rails 15R and 15L. The frame rails 15R and 15L are secured to the mounting plate (not shown) with frame rail fasteners 55. Accordingly, a U-shaped rear brake-securing plate 57 having apertures 59 is slid over the outside of the frame rails 15R and 15L and attached to the mounting plate (not shown) with the frame rail fasteners 55. The U-shaped rear brake-securing plate 57 has a lower frame bracket hook ridge **33*b*, which is similar to the lower frame bracket hook ridge 33*a* that is integrated into the integral frame rail design skate. The support hooks 51 of the arm 25 engage the hook ridge 33*b*, securing the arm 25 to an upper portion of the lower frame 14**.

Figure 8:
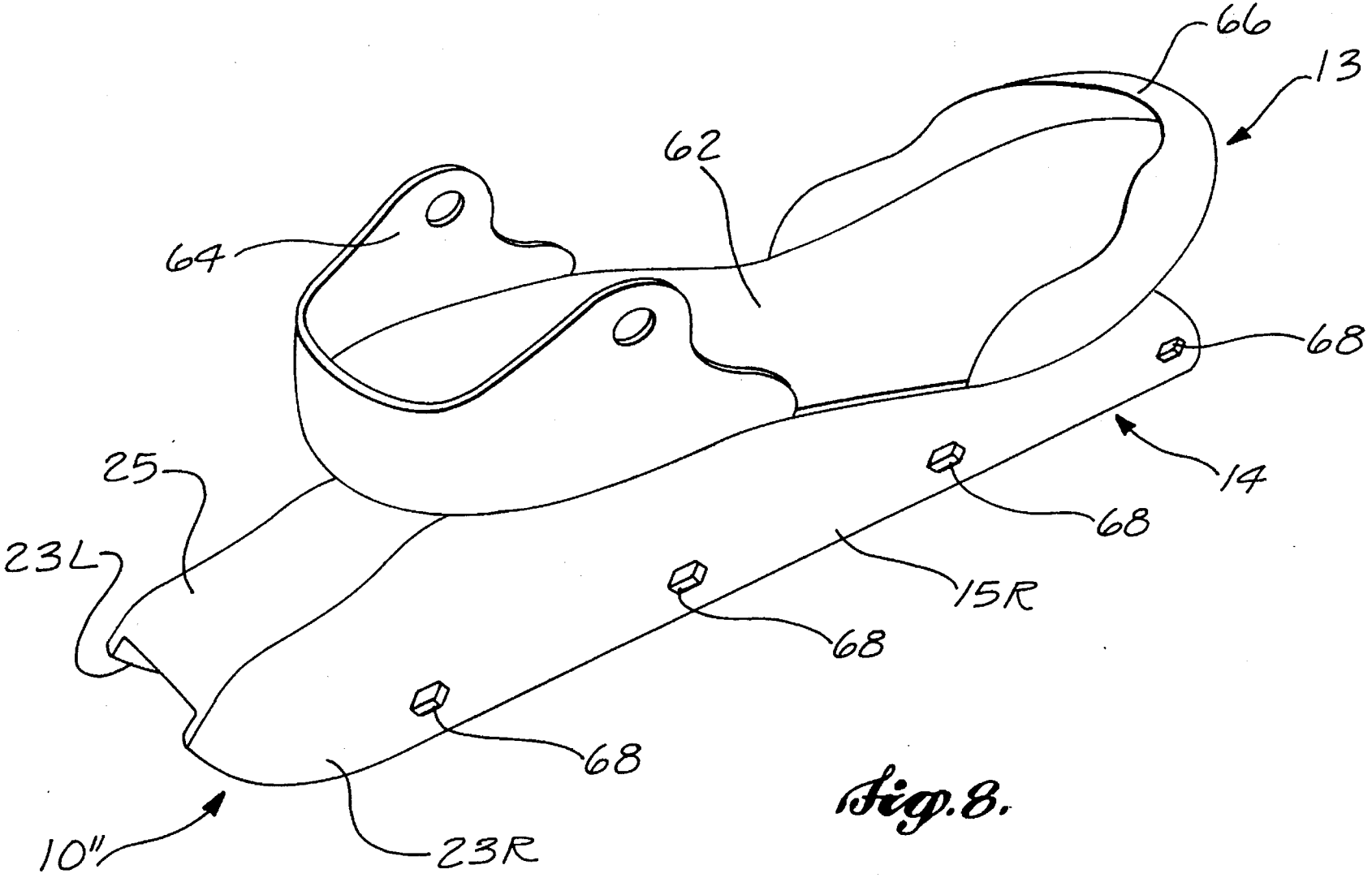
FIG. 8 is a perspective view of an alternate embodiment of the present invention constructed as a one piece molded frame that includes a brake mount.

Referring to FIG. 8, another embodiment of the present invention will be described. In this embodiment, the lower frame 14, the mounting arm 25 of the rear-mounted braking system 10", and a base 62 of the upper shoe 13 are preferably one integrally molded piece. The mounting arm 25 is not a separate, removable brake mounting structure, but extends from a heel counter 64 at the rear of the base 62. The mounting plates 23R and 23L are formed as extensions of the frame rails 15R and 15L, respectively.

FIG. 8 illustrates the entire one-piece, molded unit without wheels 17, upper shoe 13 (except for the base 62 including the heel counter 64 and a toecap 66), and the brake pad 21. Hexagonal holes 68 are formed in the frame rails 15R and 15L ready to receive the barrel bolt **19*a* and the axle bolt 19B as well as the plugs 47 to secure the wheels 17 in place. The mounting arm 25 is also ready to receive the brake pad 21. The brake pad 21 is still removable and replaceable in this embodiment of the rear-mounted braking system 10"**.

Preferably, in the alternate embodiment illustrated in FIG. 8, the base 62, the lower frame 14, and the rear-mounted braking system 10" are injection molded with a plastic or composite plastic material. The remaining portions of the upper shoe 13, the wheels 17, and the brake pad 21 are then added to complete the skate 11.

The advantages to an integral lower frame 14 are numerous. The arrangement brings down the cost of the entire skate 11. Minimal assembly is required and, with fewer parts, assembly tolerances are less critical and easier to control. Structural integrity is also easier to obtain and control since joints between the rear-mounted braking system 10" and frame rails 15R and 15L, for example, are nonexistent. The force applied to the rear-mounted braking system is efficiently transmitted to the frame rails 15 and the base 62. The structural integrity of the base attachment to the frame rails 15 is likewise good. Fillets or gussets can easily be used between the frame rails 15 and the base 62, if needed, simply by including them in the injection molds.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A braking system adapted for use on in-line roller skate having an upper shoe, and a lower frame that includes a plurality of wheels rotatable in a common, longitudinally extending plane, said plurality of wheels being attached to said lower frame by a plurality of axles and having a forwardmost wheel and rearwardmost wheel, said braking system comprising:

(a) a substantially rigid brake housing adapted for attachment to a rear portion of said lower frame at least at three points, said brake housing including:

(i) a pair of plates adapted for attaching said brake housing to the lower frame, said plates being spaced apart but substantially parallel to each other, a forwardmost portion of each plate when mounted on the in-line roller skate, including an aperture of inserting a fastener therethrough for securing said plates to the lower frame at two of said at least three point; and (ii) an arm coupled between the pair of plates and extending forwardly of the housing when mounted ion the in-line roller skate, said arm being adapted for attaching said brake housing to the lower frame at least at one point that is offset from the points at which the pair of plates are attached to the lower frame; and (b) a brake pad attached to a bottom portion of said brake housing said pad having an upper portion with other side walls engaging inner surfaces of said pair of plates and support ridges engaging lower surfaces of said pair of plates said brake pad being secured in place using grooves formed in one of the outer side walls of said upper portion of the brake pad and the inner surfaces of the pair of plates that engage ridges formed in the other of the outer side walls of said upper portion of the brake pad and the inner surfaces of the pair of plates, and a fastener that is generally aligned with the grooves and ridges, said fastener being used to secure the brake pad to the brake housing, said brake pad having a braking surface for contacting a riding surface, said grooves and ridges extending in a direction transverse to said braking surface and at an angle to said support ridge to counter shear forces involved in braking.

2. The braking system of claim 1, wherein said fastener employed for securing said plates to said lower frame is adapted to comprise an axle assembly for a wheel on an in-line roller skate.

3. The braking system of claim 1, wherein said plates comprise lateral supports for said brake pad, each plate having one of the ridges sized for engaging a corresponding one of the grooves, which are disposed in said brake pad, said ridges and said corresponding grooves being substantially vertical when the braking system is mounted to an in-line roller skate standing upright on a level surface, in a position of normal use.

4. The braking system of claim 1, Wherein said arm generally defines an acute angle with a plane extending between a top portion of said plates, and wherein said brake pad is secured to said plates and said arm proximate an apex of said acute angle.

5. The braking system of claim 1, wherein said arm comprises:

(a) a substantially curved elongate plate, said elongate plate having a forward end and a rearward end, said forward end of said elongate plate having attachment means adapted for attaching said plate to an upper portion of said lower frame, said rearward end extending laterally between the plates, said elongate plate and a plane extending between a top portion of the pair of plates forming an apex of an acute angle at said rearward end of the elongate plate;

(b) a pair of braces attached to opposed edges of said elongate plate, said braces providing rigidity and strength to said elongate plate; and (c) a brake pad attachment lug extending generally in alignment with the ridges and grooves, and threaded to receive the fastener for securing the brake pad to the brake pad housing proximate said apex of said acute angle.

6. The braking system of claim 5, wherein said attachment means comprises hook means adapted for engaging a ridge on a rear portion of said lower frame.

7. The braking system of claim 5, wherein the brake pad has an aperture extending at least part way through it for matingly engaging the attachment lug, said attachment lug extending into the aperture of the brake pad for securing the brake pad to the brake pad housing proximate said apex of said acute angle.

8. The braking system of claim 6, wherein said hook means comprise two arcuate sections separated by a gap.

* * * * *

UNITED STATES PATENT AND TRADEMARK OFFICE

CERTIFICATE OF CORRECTION

PATENT NO. : 5,470,085

DATED : November 28, 1995

INVENTOR(S) : A.A. Meibock et al.

It is certified that error appears in the above-indentified patent and that said Letters Patent is hereby corrected as shown below:

| COLUMN | LINE | |
|---|---|---|
| 2 | 23 | "off fictional" should read --of frictional-- |
| 3 | 43 | "1 a" should read --1 is a-- |
| 3 | 56 | "5 a" should read --5 is a-- |
| 3 | 59 | "is sectional" should read --is a sectional-- |
| 3 | 64 | "plate." should read --plate; and-- |
| 4 | 24 | "specifically.," should read --specifically,-- |
| 4 | 42 | "requiting" should read --requiring-- |
| 5 | 17 | "secure, he" should read --secure the-- |
| 5 | 55 | "fight" should read --right-- |
| 6 (Claim 1, | 54 line 1) | "on in-line" should read --on an in-line-- |
| 7 (Claim 1, | 1 line 15) | "of" should read --for-- |

UNITED STATES PATENT AND TRADEMARK OFFICE

CERTIFICATE OF CORRECTION

PATENT NO. : 5,470,085

DATED : November 28, 1995

INVENTOR(S) : A.A. Meibock et al.

It is certified that error appears in the above-indentified patent and that said Letters Patent is hereby corrected as shown below:

| COLUMN | LINE | |
|---|---|---|
| 7 (Claim 1, | 6 line 20) | "ion" should read --on-- |
| 7 (Claim 1, | 12 line 26) | "housing said" should read --housing, said-- |
| 7 (Claim 1, | 12 line 26) | "other" should read --outer-- |
| 7 (Claim 1, | 15 line 29) | "plates said" should read --plates, said-- |
| 8 (Claim 4, | 2 line 1) | "Wherein" should read --wherein-- |

Signed and Sealed this

Fifth Day of March, 1996

*Attest:*

*Attesting Officer*

BRUCE LEHMAN

*Commissioner of Patents and Trademarks*